US010130188B2

(12) United States Patent
Neighbours

(10) Patent No.: US 10,130,188 B2
(45) Date of Patent: Nov. 20, 2018

(54) 3-IN-1 CONVERTIBLE FURNITURE PIECE

(71) Applicant: Joseph Neighbours, Belgium, WI (US)

(72) Inventor: Joseph Neighbours, Belgium, WI (US)

( * ) Notice: Subject to any disclaimer, the term of this patent is extended or adjusted under 35 U.S.C. 154(b) by 155 days.

(21) Appl. No.: 15/267,365

(22) Filed: Sep. 16, 2016

(65) Prior Publication Data

US 2018/0078045 A1 Mar. 22, 2018

(51) Int. Cl.
*A47C 7/16* (2006.01)
*A47C 17/62* (2006.01)
*A47C 17/16* (2006.01)

(52) U.S. Cl.
CPC ..... *A47C 17/62* (2013.01); *A47C 17/16* (2013.01)

(58) Field of Classification Search
CPC ..... A47C 17/16; A47C 17/62
USPC ..... 5/2.1, 35, 37.1
See application file for complete search history.

(56) References Cited

U.S. PATENT DOCUMENTS 4,506,927 A 3/1985 Lombardo
4,619,005 A 10/1986 Rutens
5,522,097 A 6/1996 Ciccotelli
6,976,732 B2 * 12/2005 Thomas ..... A47B 85/04 297/1

* cited by examiner

*Primary Examiner* — Fredrick C Conley
(74) *Attorney, Agent, or Firm* — Ziolkowski Patent Solutions Group, SC

(57) ABSTRACT

A convertible furniture piece includes a base frame, pivotable arms connected to the base frame, and a back member rotatably connected to the pivotable arms, the back member comprising first and second portions coupled together by a linkage system. The connection of the pair of pivotable arms to the base frame comprises a first pivot point that enables translation of the back member between a generally upright couch position and a horizontal table position, with the first and second portions of the back member being joined in each of the couch position and the table position. The connection of the back member to the pair of pivotable arms comprises a second pivot point that enables translation of the back member between a generally upright couch position and a bed position, with the first and second portions of the back member being rotated relative to one another in the bed position.

21 Claims, 6 Drawing Sheets

3-IN-1 CONVERTIBLE FURNITURE PIECE

BACKGROUND OF THE INVENTION

Embodiments of the invention relate generally to convertible furniture pieces and, more particularly, to a 3-in-1 convertible furniture piece that converts between a couch, bed, and table.

The combination of furniture functions in a single unit to provide various uses and reduce expense is generally known. Such "convertible furniture" pieces are practical and useful in small living spaces, such as dorms, small apartments or mini-homes, as the convertible furniture allows for a single furniture piece to have multiple uses/functions while taking up a small amount of space. One example of a convertible furniture piece is the well known "sleeper" sofa—which can be converted from a sofa to a bed and generally require the removal of a portion of a sofa's cushions, and the unfolding of a bed frame and mattress.

Other known convertible furniture pieces are constructed to provide 3-way functionality—such as functioning as a sofa, bed, and desk. However, existing furniture pieces typically provide such 3-way functionality only via the use of completely separate and distinct elements in which none of the elements provide functional versatility. That is, with these furniture pieces, one or more elements must typically be completely removed from the piece (and another element added) when converting from one function to another. In sum, existing convertible furniture pieces in the prior art are typically little more than an aggregation of distinct components that provide little versatility and are often cumbersome to manage when switching between the functionalities of the furniture piece.

Therefore, it would be desirable to provide a convertible furniture piece that enables a combination of furniture functions via the use of versatile components therein, so as ease the transformation of the piece into its different respective functional states and minimize the cost of the piece. It would also be desirable for such a convertible furniture piece to not require the complete removal of specific components during the transformation of the piece, so as to eliminate the need for storing such components when not in use.

BRIEF DESCRIPTION OF THE INVENTION

In accordance with one aspect of the invention, a convertible furniture piece includes a base frame having a pair of end frames and a cross-frame, a pair of pivotable arms rotatably connected to the base frame, with a respective pivotable arm being connected to each of the end frames, and a back member rotatably connected to the pair of pivotable arms, the back member comprising a first portion and a second portion coupled together by a linkage system provided on each of opposing sides thereof and being selectively joined and rotated relative to one another via movement of the linkage system. The connection of the pair of pivotable arms to the base frame comprises a first pivot point in the convertible furniture piece, the first pivot point enabling translation of the back member between a generally upright couch position and a horizontal table position, with the first and second portions of the back member being joined in each of the couch position and the table position. The connection of the back member to the pair of pivotable arms comprises a second pivot point in the convertible furniture piece, the second pivot point enabling translation of the back member between a generally upright couch position and a bed position, with the first and second portions of the back member being rotated relative to one another in the bed position, with the first portion being in a horizontal position when the back member is in the bed position.

In accordance with another aspect of the invention, a convertible furniture piece is provided that is operable in each of a couch position, a bed position, and a table position. The convertible furniture piece includes a base frame having a pair of end frames and a cross-frame, a pair of pivotable arms rotatably connected to the base frame, with a respective pivotable arm being connected to each of the end frames, and a back member rotatably connected to the pair of pivotable arms, the back member comprising a first portion and a second portion coupled together by a linkage system provided on each of opposing sides thereof and being selectively joined and rotated relative to one another via movement of the linkage system. The convertible furniture piece also includes a latch formed on each of opposing sides of the first portion of the back member and being movable between a protruded position and a retracted position. Each of the latches, when in the protruded position, holds its respective linkage system in a locked position so as to cause the first and second portions of the back member to remain joined. Each of the latches, when in the retracted position, releases its respective linkage system from the locked position so as to allow the first and second portions of the back member to be rotated relative to one another. The convertible furniture piece is operable in the couch position and the table position when the linkage systems are in their locked position and is operable in the bed position when the linkage systems are released from their locked position.

Various other features and advantages will be made apparent from the following detailed description and the drawings.

BRIEF DESCRIPTION OF THE DRAWINGS

The drawings illustrate preferred embodiments presently contemplated for carrying out the invention.

In the drawings.

DETAILED DESCRIPTION

Embodiments of the invention provide a convertible furniture piece that folds from a couch to a bed and flips from a couch to a table. The convertible furniture piece includes two pivot points—a first pivot point to swing the backrest of the couch down into a bed position and a second pivot point for swinging the couch into a table position. There are also legs for the bed that function as a support for the backrest of the couch, with the legs folding out in place automatically as the backrest is lowered. The backrest of the couch is also part of the table on the reverse side, and the furniture piece must be secured in couch position before it is folded up into a table—with the couch being swung into a table via the second pivot point.

Figure 1:
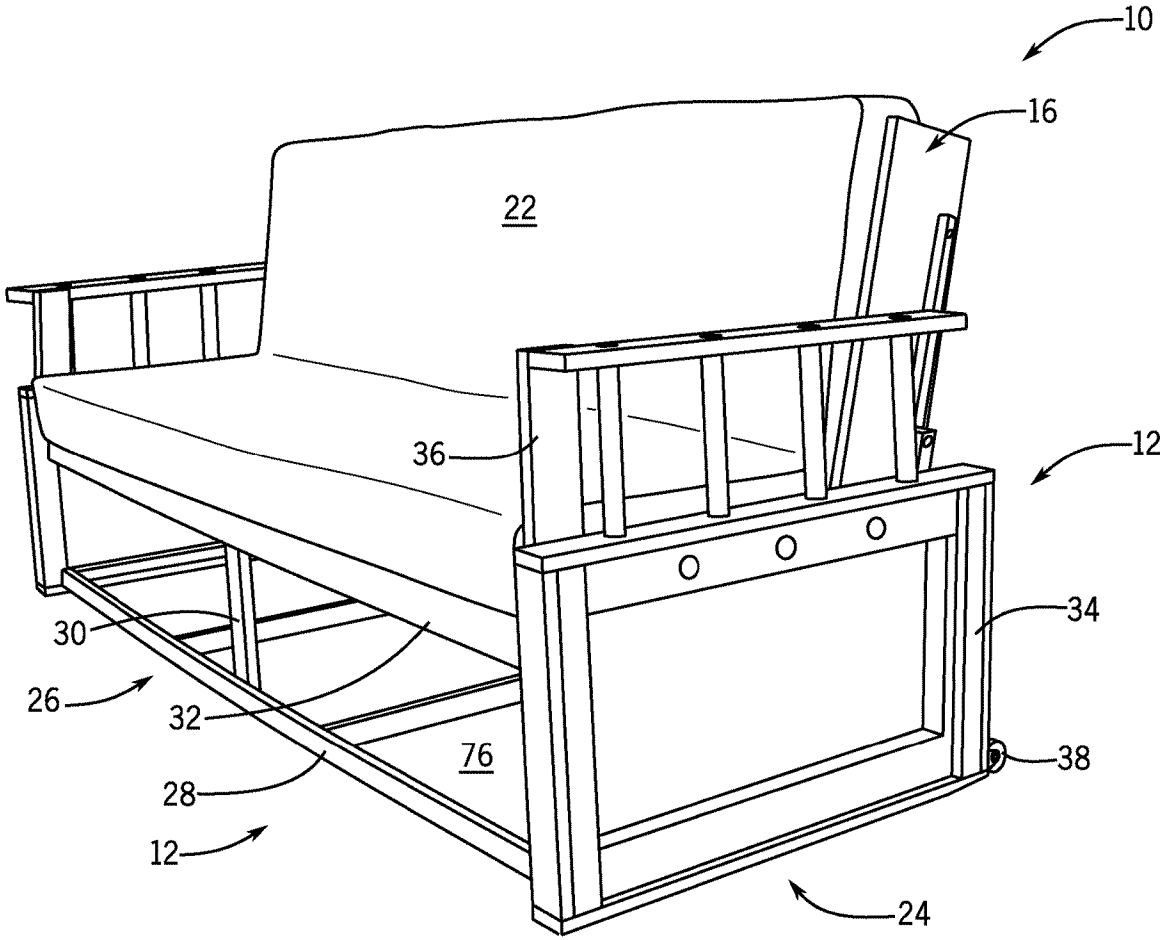
FIGS. 1-8 are various perspective views of a convertible furniture piece in a couch mode, bed mode and table mode, with and without a cushion thereon, according to an embodiment of the invention.
Figure 2:
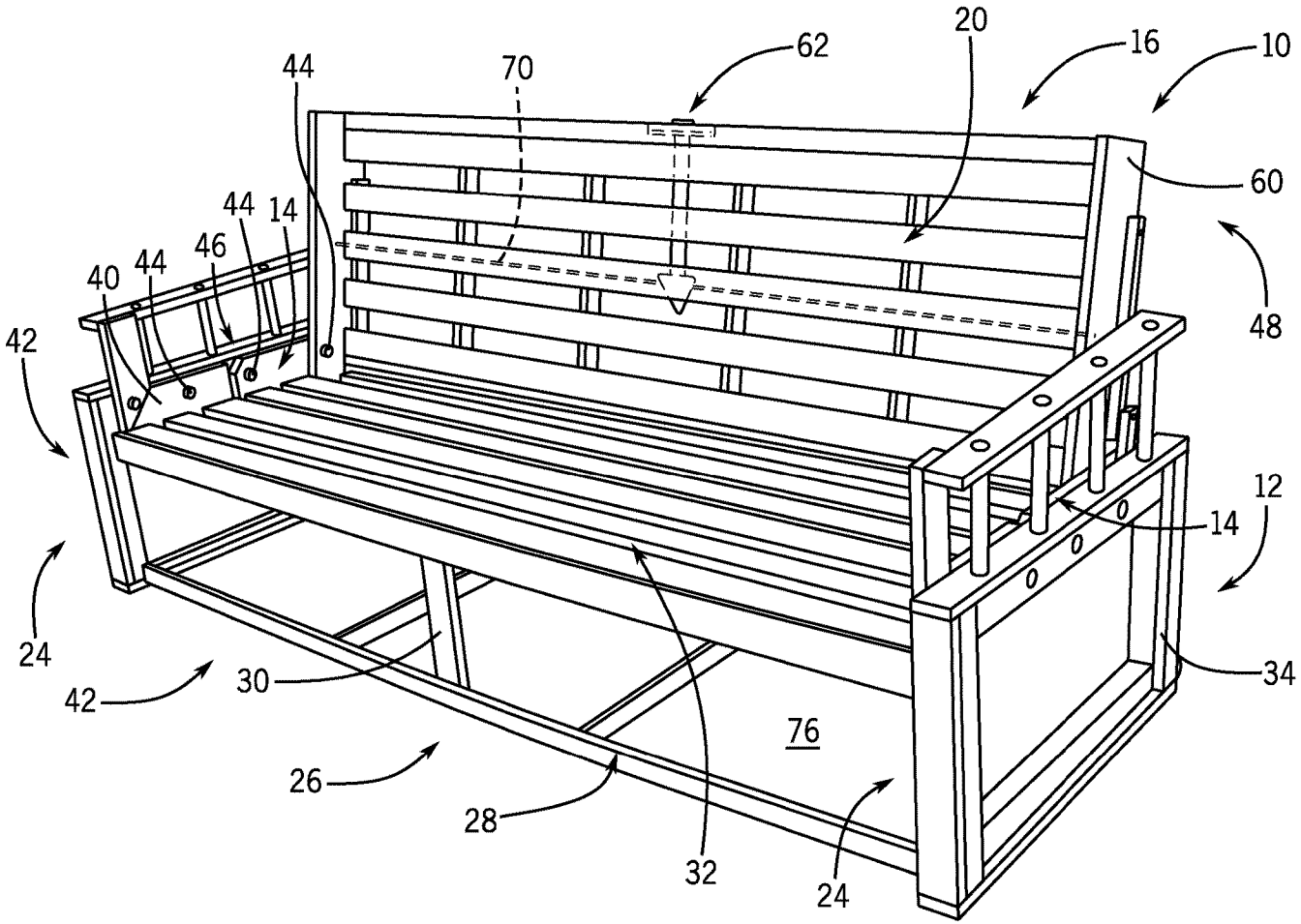
Figure 3:
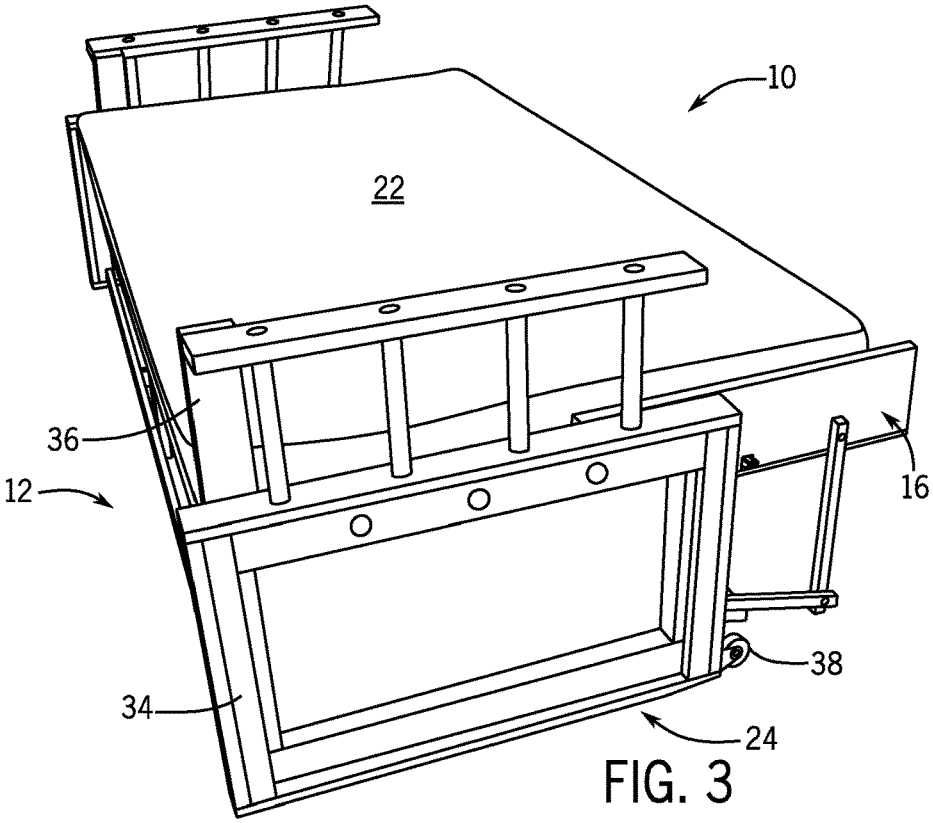
Figure 4:
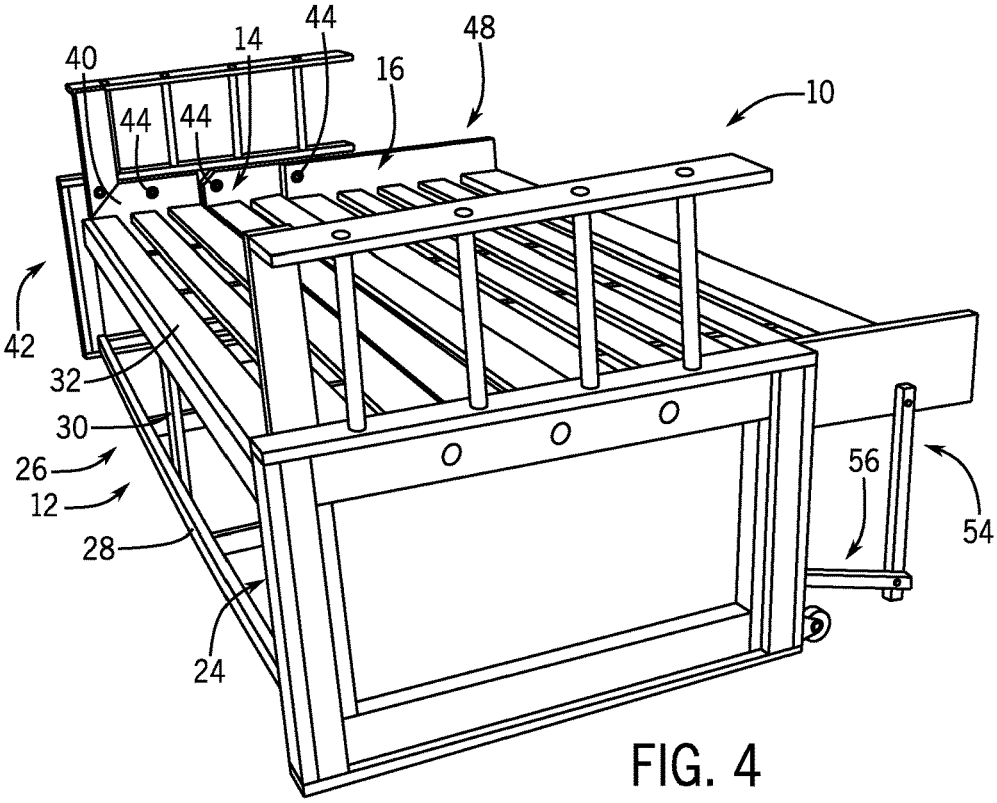
Figure 5:
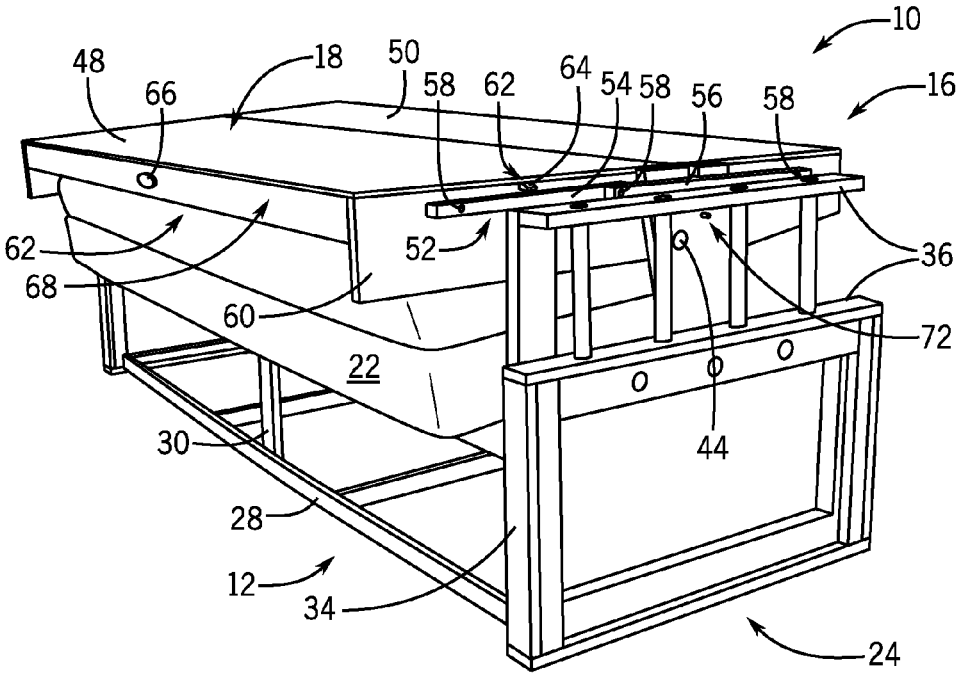
Figure 6:
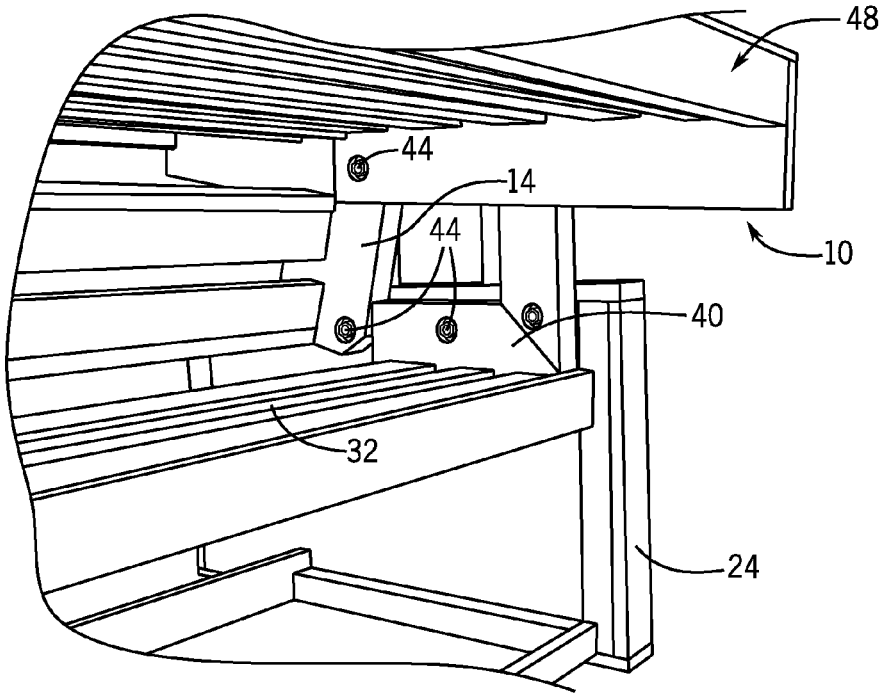

Referring to FIGS. 1-6, views of a 3-in-1 convertible furniture piece 10 in each of its three functional states are shown according to an exemplary embodiment of the invention. More specifically, FIGS. 1 and 2 illustrate the convertible furniture piece 10 in a state where it functions as a couch, FIGS. 3 and 4 illustrate the convertible furniture piece 10 in a state where it functions as a bed, and FIGS. 5 and 6 illustrate the convertible furniture piece 10 in a state where it functions as a table. The convertible furniture piece 10 is composed generally of a base frame 12, a pair of pivotable arms 14, and a back member 16 joined to the pivotable arms 14—with the back member including a table surface 18 and a bed support surface 20 that provide dual functionality as a table and couch back. The construction and connection of these elements is such that they provide versatility between the respective couch, bed, and table functions, so as to allow for the convertible furniture piece 10 to easily switch between states without requiring components or parts to be removed or added. A multi-function cushion 22 is also included in convertible furniture piece 10 that serves as both a couch cushion and a bed cushion, with the convertible furniture piece 10 providing for stowing away of the cushion 22 in an unobstructive position when the piece is being utilized as a table.

As can be seen in FIGS. 1-6, the base frame 12 of the convertible furniture piece 10 includes a pair of end frames 24 that are joined together by a cross-frame 26. The cross-frame 26 is constructed from base or floor boards 28, vertical support members 30, and seat boards 32. The base/floor boards 28 provide a solid base for supporting the convertible furniture piece 10 and serve as connections between the end frames 24. The seat boards 32 serve as connections between the end frames 24 and also form a seat base for the convertible furniture piece 10 when utilized as a couch and/or a portion of a bed base when utilized as a bed. The vertical support members 30 are positioned at one or more locations between the end frames 24 and extend between the base/floor boards 28 and the seat boards 32, so as to provide support for the seat boards 32.

Each of the end frames 24 of the base frame 12 is formed of a bottom member 34 and a rail member 36. The bottom member 34 of the end frame 24 is joined to the base/floor boards 28 and the seat boards 32 of cross-frame 26 to collectively provide a stable base for the convertible furniture piece 10. The rail member 36 extends upwardly from a top surface of the bottom member 34 to a height that provides a comfortable arm rest for the convertible furniture piece 10 when being utilized as a couch. The rail member 36 also services as a support for the back member 16 when the convertible furniture piece 10 is being utilized as a table, as will be explained in greater detail below.

In an exemplary embodiment of the invention, each of the end frames 24 includes one or more wheels 38 thereon that is/are affixed to a back edge of the bottom member 34. When the front of the convertible furniture piece 10 is picked up while in the couch mode, the convertible furniture piece 10 is tipped back onto the wheels 38—thereby allowing the convertible furniture piece 10 to be wheeled around and provide mobility to the piece. Incorporation of the wheels 38 on the end frames 24 allows for the convertible furniture piece 10 to be pulled easily away from a wall to make room for transition of the convertible furniture piece 10 into a bed.

As shown in FIGS. 1-6, the base frame 12, pivotable arms 14, and back member 16 are constructed, arranged and connected to one another in order to provide for rotation of the pivotable arms 14 and back member 16 and enable transitioning of the convertible furniture piece 10 between its respective couch, bed and table modes/positions. As shown therein, an inner surface of each of the end frames 24 includes a stop board 40 and a respective one of the pivotable arms 14 attached thereto. The stop board 40 on each end frame 24 is positioned adjacent a front side 42 of the convertible furniture piece 10 and just above the seat boards 32, with the stop board 40 being secured to the end frame 24 in a stationary position via the use of one or more bolts or other suitable fasteners 44. The pivotable arm 14 on each end frame 24 is positioned adjacent a back edge of the stop board 40 and just above the seat boards 32.

As can be seen in FIG. 6 (relative to FIGS. 2 and 4), the pivotable arm 14 is secured to the end frame 24 via the use of a bolt or other suitable fastener 44 (e.g. a bolt and accompanying nut) and is coupled thereto in such a fashion that the pivotable arm 14 may be rotated relative to the end frame 24—with this pivotable connection between the pivotable arm 14 and the end frame 24 being termed as a "first pivot point" in the convertible furniture piece 10 that allows for transforming of the convertible furniture piece 10 between the couch mode and the table mode. To provide for such rotation, the bolt 44 is inserted through pivotable arm 14 proximate an end thereof that is adjacent stop board 40—such that rotation of the pivotable arm 14 in an upward direction is enabled. As a further means for enabling rotation of the pivotable arm 14, the end of pivotable arm 14 is formed to have a chamfered upper corner 46 thereon—with the chamfered corner 46 providing for rotation of the pivotable arm 14 without the pivotable arm 14 making contact with and getting stuck on stop board 40. The stop board 40 serves as a stop for the pivotable arm, such that the pivotable arm 14 cannot be over rotated when the back member 16 is moved to a table position.

Figure 7:
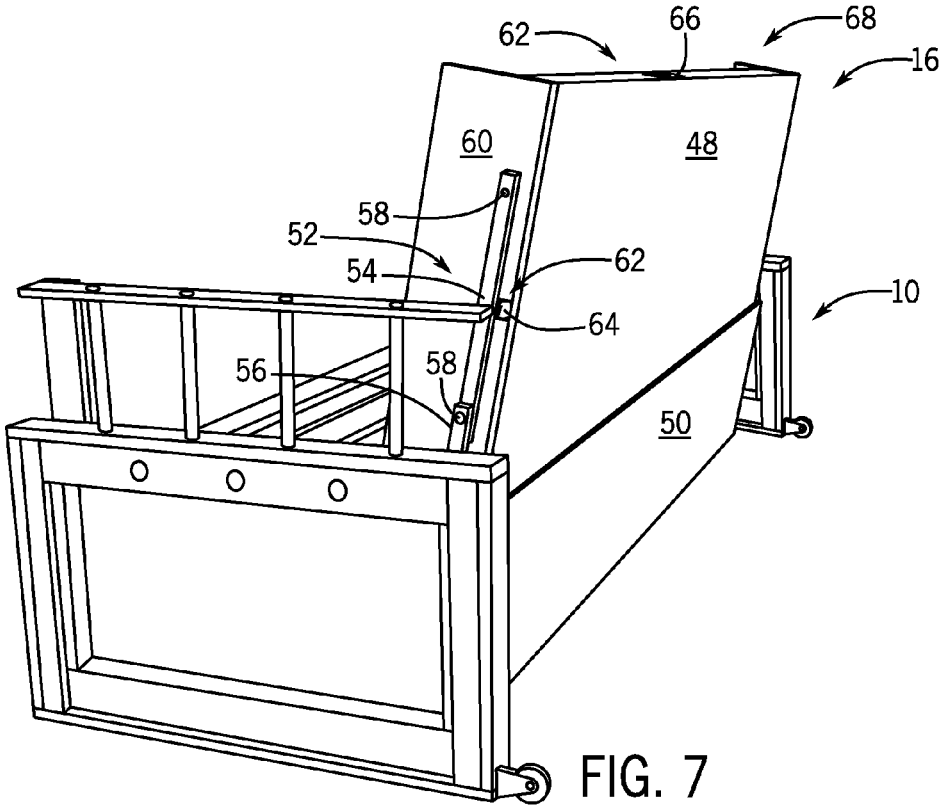

Referring still to FIG. 5 and now also to FIG. 7, the back member 16 is shown and described in more detail. As best seen in FIG. 7, the back member 16 is formed as a two-piece that includes a first portion 48 and a second portion 50. The first and second portions 48, 50 of back member 16 are coupled via a linkage system 52 having first and second links 54, 56. The first link 54 is rotatably joined to the first portion 48 of back member 16 on one end thereof and the second link 56 is rotatably joined to the second portion 50 of back member 16 on one end thereof, such as via a locking pin 58 or another suitable fastener securing the link to an end board 60 of the back member 16 portion. The first and second links 54, 56 are then rotatably joined to one another at the ends of the links opposite from where they are joined to the respective portions of the back member 16.

In order to facilitate transitioning of the convertible furniture piece 10 between the couch, bed, and table modes, a latching system 62 is provided on the back member 16 that interacts with the linkage system 52. The latching system 62 includes thereon two door style latches 64 that are provided on opposing sides of the first portion 48 of back member 16 (i.e., formed in the end boards 60 of first portion 48), as well as a release member or latch 66 formed on a front edge 68 of the first portion 48 of back member 16—at, for example, a mid-point along the front edge 68. In an exemplary embodiment, the release member 66 is operatively connected to the door-style latches 64 via connecting cables 70 such that, when the release member 66 is actuated by a user, the connecting cables 70 cause the door-style latches 64 to move. This movement caused by connecting cables 70 causes the door-style latches 64 to retract inwardly from a protruded position to a retracted position where the door-style latches 64 do not extend out from the end boards 60. When the door-style latches 64 are in the retracted position, they release the linkage system 52 and enable rotation between the first and second links 54, 56. That is, the first and second links 54, 56 of each linkage system 52 are locked in a linear arrangement relative to one another and relative to the back member 16 by the door-style latches 64 when they are in their protruded position—thereby causing the first and second portions 48, 50 of the back member 16 to be retained together and present a flat back member 16. But when the door-style latches 64 are moved to their retracted position, the linkage systems 52 are released by the door-style latches 64 and the links 54, 56 thereof are allowed to rotate relative to one another, thereby enabling the first and second portions 48, 50 of the back member 16 to be rotated relative to one another.

As shown in FIGS. 2, 4, 5 and 6, the first portion 48 of back member 16 is rotatably coupled to the pivotable arms 14 positioned on the end frames 24, with bolts or other suitable fasteners 44 (e.g. a bolt and accompanying nuts) being used to secure the first portion 48 to the pivotable arms 14 and provide for rotation therebetween—with this pivotable connection between the first portion 48 and the pivotable arm 14 being termed as a "second pivot point" in the convertible furniture piece 10 that allows for transforming of the convertible furniture piece 10 between the couch mode and the bed mode. To provide for such rotation, a bolt 44 is inserted through the end board 60 provided on each side of the first portion 48 of back member 16, with the bolts 44 being inserted through the end boards 60 proximate an end thereof that is adjacent the respective pivotable arms 14—such that rotation of the back member 16 between an upright position and a flat position is enabled.

Following now, the positioning and use of the convertible furniture piece 10 in each of a couch mode, bed mode, and table mode will be described in more detail. Referring first to FIG. 2, and with reference also to FIG. 7, positioning and use of the convertible furniture piece 10 in the couch mode will be described in more detail. When desiring to use the convertible furniture piece 10 in the couch mode, a user translates the back member 16 to orient it in an upright position. When transforming the convertible furniture piece 10 from the bed mode to the couch mode, the translation of the back member 16 entails the user merely pulling up the back member 16 in an upward motion (and pulling towards the user), such as might be accomplished by pulling on a central location on the back member 16 on the front edge thereof—i.e., on a front edge 68 of the first portion of back member 16. According to one embodiment, a pull strap or other similar device (not shown) may be provided on the front edge 68 of the back member 16 to allow the user to more efficiently pull the back member 16 in such a manner. Upon a pulling of the back member 16 by the user toward the upright position, the first and second links 54, 56 of the linkage system 52 are caused to rotate relative to one another into a linear arrangement (i.e., the first and second links 54, 56 are aligned). The first link 54 on each end of the back member 16 interacts with its respective door-style latch 64 when the back member 16 moves toward the upright position and is locked in place by the door-style latch 64 upon reaching the upright position—thereby securing the back member 16 in the upright position and putting the convertible furniture piece 10 in the couch mode/position.

When transforming the convertible furniture piece 10 from the table mode to the couch mode, the translation of the back member 16 entails the user first releasing a pin 72 that locks the convertible furniture piece 10 in the table position. Upon releasing of the pin 72, the user pushes the back member 16 in a backward (away from the user) and upward motion, such as might be accomplished by pushing on a central location on the back member 16 on a front edge thereof—i.e., on a front edge 68 of the first portion 48 of back member 16. Upon a pushing of the back member 16 by the user, the back member 16 begins to rotate toward the upright position, with the first and second links 54, 56 of the linkage system 52 remaining locked relative to one another in a linear arrangement (i.e., the first and second links 54, 56 are aligned). The first link 54 on each end of the back member 16 interacts with its respective door-style latch 64 when the back member 16 moves toward the upright position and is locked in place by the door-style latch 64 upon reaching the upright position—thereby securing the back member 16 in the upright position and putting the convertible furniture piece 10 in the couch mode/position.

Referring now to FIGS. 4 and 7, positioning and use of the convertible furniture piece 10 in the bed mode will be described in more detail. When desiring to use the convertible furniture piece 10 in the bed mode, it is recognized that such transitioning to the bed mode can only be made from the couch position. In transitioning from the couch mode to the bed mode, a user translates the back member 16 to orient it in a horizontal position. More specifically, the first portion 48 of the back member 16 will be oriented in a horizontal position, while the second portion 50 of the back member 16 will rotate relative to the first portion 48, to a position that will be underneath the first portion. When transforming the convertible furniture piece 10 from the couch mode to the bed mode, the translation of the back member 16 entails the user activating the latching system 62 to allow the convertible furniture piece 10 to translate to the bed mode. That is, the user pulls on the release member or latch 66 formed on the front edge 68 of the first portion 48 of back member 16—with pulling of the release member 66 causing the two door style latches 64 on opposing sides of the first portion 48 of back member 16 (via the interaction therebetween provided by connecting cables) to retract inwardly from a protruded position to a retracted position, where the door-style latches 64 do not extend out from the end boards 60. By retracting the door-style latches 64, the linkage system 52 is released and rotation between the first and second links 54, 56 thereof is enabled. Rotation between the first and second links 54, 56 allows the back member 16 to be rotated from the upright position down to the horizontal position—such that the back member 16 and the seat boards 32 of cross-frame 26 are aligned and present a planar surface that serves as a bed. When the back member 16 is moved down to the horizontal position, the first and second links 54, 56 are rotated in such a manner so as to serve as legs for the bed. That is, as can be seen in FIG. 4, the end of first link 54 that is joined to second link 56 is rotated and positioned such that it oriented in a vertical position and is caused to rest upon the ground, thereby providing support for the back member 16.

Figure 8:
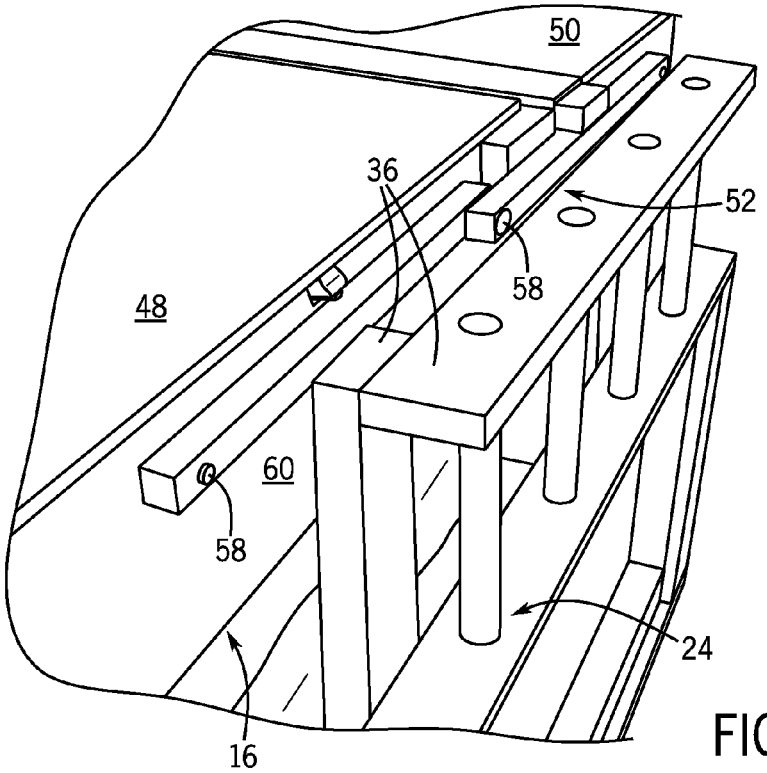

Referring now to FIGS. 5,7 and 8, positioning and use of the convertible furniture piece 10 in the table mode will be described in more detail. When desiring to use the convertible furniture piece 10 in the table mode, it is recognized that such transitioning to the table mode can only be made from the couch position. In transitioning from the couch mode to the table mode, a user translates the back member 16 to orient it in a horizontal position. The translation of the back member 16 entails the user pulling the back member 16 in a forward motion (towards the user), such as might be accomplished by pulling on a central location on the back member 16 on a front edge thereof—i.e., on the front edge 68 of the first portion 48 of back member 16. According to one embodiment, a pull strap or other similar device (not shown) may be provided on the front edge 68 of the back member 16 to allow the user to more efficiently pull the back member 16 in such a manner. Upon a pulling of the back member 16 by the user in a forward motion, back member 16 is caused to translate forward and rotate from the upright position to a horizontal position—with the first and second portions 48, 50 of the back member 16 remaining together (via linkage systems 52 remaining in a locked/linear position) so as to present a planar table-top surface. When the back member 16 is horizontal and in a table mode position, the back member 16 is supported by the rail members 36 of the convertible furniture piece 10. Specifically, when the back member 16 is horizontal and in a table mode position, the linkage systems 52 are positioned such that they rest on the rail members 36 of the end frames 24 and are supported thereby. According to an exemplary embodiment, the back member 16 may be locked in place via a pin 72 that is incorporated into rail member 36, so as to prevent undesired movement of the table.

Figure 9:
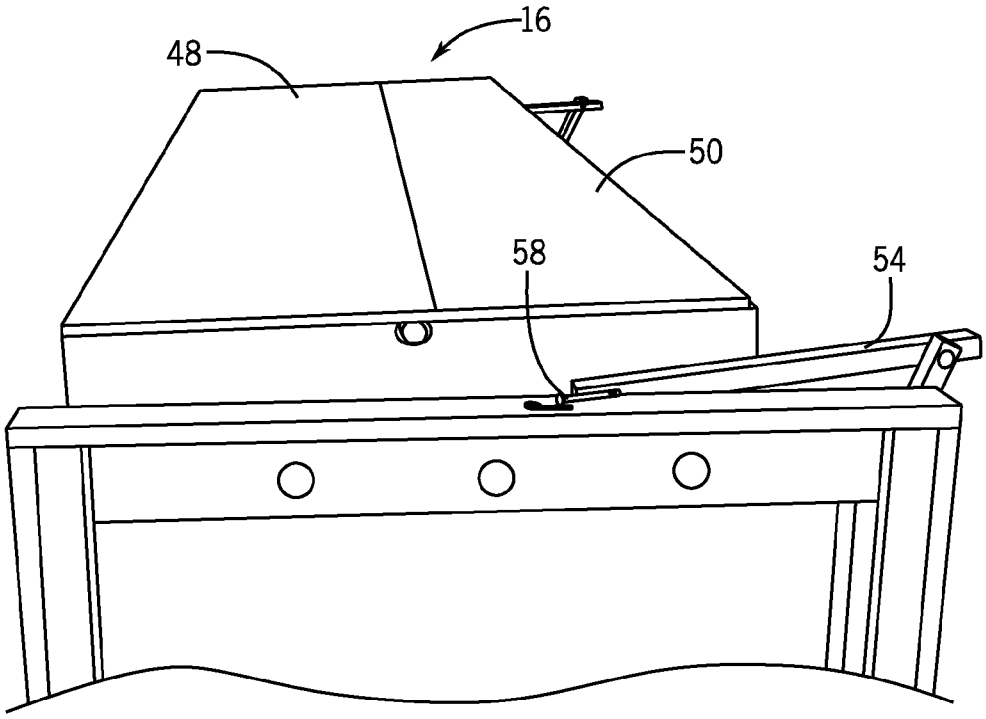
FIG. 9 is a perspective view of the convertible furniture piece of FIGS. 1-8 with the back member in a storage position, according to an embodiment of the invention.

According to an exemplary embodiment of the invention, additional features may be incorporated into convertible furniture piece 10 that provide ease in shipping of the device and provide storage capabilities for the device. In one embodiment, and as shown in FIG. 9, the pin 58 used to join the first link 54 to the first portion 48 of back member 16 may be removable—such that the first link 54 can be decoupled from the back member 16. The decoupling of the first link 54 on each of opposing sides of the first portion 48 of back member 16 allows for rotation of the first portion 48 of back member 16 down into a position where it rests directly on seat boards 32, thereby minimizing the height of the convertible furniture piece 10 and providing a compact form in which it may be shipped. In order to further minimize the height of the convertible furniture piece 10 and provide a compact form for shipping, the rail members 36 may be constructed to be detachable from end frames 24, with FIG. 9 illustrating the convertible furniture piece 10 with rail members 36 being removed. In one embodiment, and as can be seen in FIGS. 1 and 2, for example, the base frame 12 of the convertible furniture piece 10 that includes the pair of end frames 24 and the cross-frame 26 (which further includes base or floor boards, vertical support members, and seat boards) defines a storage area 76. During shipping, this storage area 76 may provide for packaging/storing of the cushion 22 therein, while during use the storage area 76 may provide for storage of any of numerous items as desired by a user.

While the convertible furniture piece 10 illustrated and described above is formed of wood beams and framing, it is recognized that embodiments of the invention are not meant to be limited to such a construction and such materials. The structural support and frame can be made from various materials such as wood, metal, or appropriate plastic or composite material.

Beneficially, embodiments of the invention thus provide a 3-in-1 convertible furniture piece that folds from a couch to a bed and flips from a couch to a table. The convertible furniture piece enables a combination of furniture functions via the use of versatile components therein, so as ease the transformation of the piece into its different respective functional states and minimize the cost of the piece. The convertible furniture piece does not require the removal of any components during the transformation of the piece, such that it eliminates the need for storing such components when not in use and is practical for use in small living spaces such as dorms, small apartments and mini homes.

Therefore, according to one embodiment, a convertible furniture piece includes a base frame having a pair of end frames and a cross-frame, a pair of pivotable arms rotatably connected to the base frame, with a respective pivotable arm being connected to each of the end frames, and a back member rotatably connected to the pair of pivotable arms, the back member comprising a first portion and a second portion coupled together by a linkage system provided on each of opposing sides thereof and being selectively joined and rotated relative to one another via movement of the linkage system. The connection of the pair of pivotable arms to the base frame comprises a first pivot point in the convertible furniture piece, the first pivot point enabling translation of the back member between a generally upright couch position and a horizontal table position, with the first and second portions of the back member being joined in each of the couch position and the table position. The connection of the back member to the pair of pivotable arms comprises a second pivot point in the convertible furniture piece, the second pivot point enabling translation of the back member between a generally upright couch position and a bed position, with the first and second portions of the back member being rotated relative to one another in the bed position, with the first portion being in a horizontal position when the back member is in the bed position.

According to another embodiment, a convertible furniture piece is provided that is operable in each of a couch position, a bed position, and a table position. The convertible furniture piece includes a base frame having a pair of end frames and a cross-frame, a pair of pivotable arms rotatably connected to the base frame, with a respective pivotable arm being connected to each of the end frames, and a back member rotatably connected to the pair of pivotable arms, the back member comprising a first portion and a second portion coupled together by a linkage system provided on each of opposing sides thereof and being selectively joined and rotated relative to one another via movement of the linkage system. The convertible furniture piece also includes a latch formed on each of opposing sides of the first portion of the back member and being movable between a protruded position and a retracted position. Each of the latches, when in the protruded position, holds its respective linkage system in a locked position so as to cause the first and second portions of the back member to remain joined. Each of the latches, when in the retracted position, releases its respective linkage system from the locked position so as to allow the first and second portions of the back member to be rotated relative to one another. The convertible furniture piece is operable in the couch position and the table position when the linkage systems are in their locked position and is operable in the bed position when the linkage systems are released from their locked position.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A convertible furniture piece comprising:

a base frame including a pair of end frames and a cross-frame;

a pair of pivotable arms rotatably connected to the base frame, with a respective pivotable arm being connected to each of the end frames; and a back member rotatably connected to the pair of pivotable arms, the back member comprising a first portion and a second portion coupled together by a linkage system provided on each of opposing sides thereof and being selectively joined and rotated relative to one another via movement of the linkage system;

wherein the connection of the pair of pivotable arms to the base frame comprises a first pivot point in the convertible furniture piece, the first pivot point enabling translation of the back member between a generally upright couch position and a horizontal table position, with the first and second portions of the back member being joined in each of the couch position and the table position; and wherein the connection of the back member to the pair of pivotable arms comprises a second pivot point in the convertible furniture piece, the second pivot point enabling translation of the back member between a generally upright couch position and a bed position, with the first and second portions of the back member being rotated relative to one another in the bed position, with the first portion being in a horizontal position when the back member is in the bed position.

2. The convertible furniture piece of claim 1 wherein the linkage system comprises:

a first link rotatably connected to the first portion of the back member at one end thereof; and a second link rotatably connected to the second portion of the back member at one end thereof;

wherein the first and second links are rotatably connected to one another at the ends of the links opposite from where they are joined to the respective first and second portions of the back member.

3. The convertible furniture piece of claim 2 further comprising a latch formed on each of opposing sides of the first portion of the back member and being movable between a protruded position and a retracted position, with each latch being formed on the first portion so as to be adjacent a respective first link of the linkage systems.

4. The convertible furniture piece of claim 3 wherein each of the latches, when in the protruded position, holds its respective linkage system in a locked position where the first and second links are linearly arranged, with the linkage systems causing the first and second portions of the back member to remain joined when in the locked position; and wherein each of the latches, when in the retracted position, releases its respective linkage system from the locked position so as to provide for rotation between the first and second links, with the linkage system allowing the first and second portions of the back member to be rotated relative to one another when released from the locked position.

5. The convertible furniture piece of claim 3 further comprising a release member operably connected to the latches formed on the back member, wherein actuation of the release member causes the latches to move from the protruded position to the retracted position.

6. The convertible furniture piece of claim 2 wherein, when the back member is in the bed position, the first link is oriented in a vertical position and is positioned height wise relative to the base frame such that an end thereof makes contact with a ground surface.

7. The convertible furniture piece of claim 1 further comprising a stop board fixedly attached to each of the end frames, each stop board positioned adjacent a front edge of a respective one of the pivotable arms.

8. The convertible furniture piece of claim 7 wherein each of the pair of pivotable arms includes an end thereon having a chamfered corner, the chamfered corner providing a clearance between the pivotable arm and the stop board when the pivotable arm is rotated; and wherein the stop board serves as a stop for the pivotable member when the back member is translated to the horizontal table position, so as to prevent the pivotable member from over rotating and the back member from going past the horizontal table position.

9. The convertible furniture piece of claim 1 further comprising a pin positioned in each of the end frames, the pins mating with the back member when the back member is in the horizontal table position so as to secure the back member in place.

10. The convertible furniture piece of claim 1 wherein each of the end frames comprises:

a bottom member to which the cross-frame is joined; and a rail member extending upwardly from the bottom member.

11. The convertible furniture piece of claim 1 wherein the linkage system on each of opposing sides of the back member rests on the rail member of a respective end frame of the pair of end frames.

12. The convertible furniture piece of claim 1 further comprising a pair of wheels affixed to the base frame, with one wheel being attached to each of the end frames, the wheels enabling rolling of the convertible furniture piece thereon.

13. The convertible furniture piece of claim 1 further comprising a multi-function cushion configured to serve as both a couch cushion and a bed cushion, with the multi-function cushion being stowed away under the back member when the back member is in the horizontal table position.

14. The convertible furniture piece of claim 13 wherein the base frame defines a storage area sized to receive the multi-function cushion when not in use or during shipping of the convertible furniture piece.

15. A convertible furniture piece operable in each of a couch position, a bed position, and a table position, the convertible furniture piece comprising:

a base frame including a pair of end frames and a cross-frame;

a pair of pivotable arms rotatably connected to the base frame, with a respective pivotable arm being connected to each of the end frames; and a back member rotatably connected to the pair of pivotable arms, the back member comprising a first portion and a second portion coupled together by a linkage system provided on each of opposing sides thereof and being selectively joined and rotated relative to one another via movement of the linkage system; and a latch formed on each of opposing sides of the first portion of the back member and being movable between a protruded position and a retracted position;

wherein each of the latches, when in the protruded position, holds its respective linkage system in a locked position so as to cause the first and second portions of the back member to remain joined;

wherein each of the latches, when in the retracted position, releases its respective linkage system from the locked position so as to allow the first and second portions of the back member to rotate relative to one another; and wherein the convertible furniture piece is operable in the couch position and the table position when the linkage systems are in their locked position and is operable in the bed position when the linkage systems are released from their locked position.

16. The convertible furniture piece of claim 15 further comprising a release member operably connected to the latches formed on the back member, wherein actuation of the release member causes the latches to move from the protruded position to the retracted position.

17. The convertible furniture piece of claim 15 wherein each linkage system comprises:

a first link rotatably connected to the first portion of the back member at one end thereof; and a second link rotatably connected to the second portion of the back member at one end thereof;

wherein the first and second links are rotatably connected to one another at the ends of the links opposite from where they are joined to the respective first and second portions of the back member.

18. The convertible furniture piece of claim 17 wherein, when the convertible furniture piece is in the bed position, the first link is oriented in a vertical position and is positioned height wise relative to the base frame such that an end thereof makes contact with a ground surface.

19. The convertible furniture piece of claim 15 further comprising a pin positioned in each of the end frames, the pins mating with the back member when the convertible furniture piece is in the table position so as to secure the back member in place.

20. The convertible furniture piece of claim 15 wherein each of the end frames comprises a rail member formed thereon, and wherein the linkage system on each of opposing sides of the back member rests on the rail member of a respective end frame of the pair of end frames.

21. A convertible furniture piece comprising:

a base frame including a pair of end frames and a cross-frame;

a pair of pivotable arms rotatably connected to the base frame, with a respective pivotable arm being connected to each of the end frames; and a back member fixed to the pair of pivotable arms;

wherein the connection of the pair of pivotable arms to the base frame comprises a pivot point in the convertible furniture piece, the pivot point enabling translation of the back member between a generally upright couch position and a horizontal table position; and wherein the back member is positioned on a back side of the base frame when in the upright position and rotates back over and onto the base frame when moved to the horizontal table position.

* * * * *